US008660738B2

(12) United States Patent
Faivre et al.

(10) Patent No.: US 8,660,738 B2
(45) Date of Patent: Feb. 25, 2014

(54) EQUIPMENT PERFORMANCE MONITORING SYSTEM AND METHOD

(75) Inventors: Joseph L. Faivre, Edelstein, IL (US); Bradley K. Bomer, Pekin, IL (US); Chandrasekar Ramkumar, Peoria, IL (US); John J. Krone, Peoria, IL (US)

(73) Assignee: Catepillar Inc., Peoria, IL (US)

( * ) Notice: Subject to any disclaimer, the term of this patent is extended or adjusted under 35 U.S.C. 154(b) by 277 days.

(21) Appl. No.: 12/967,649

(22) Filed: Dec. 14, 2010

(65) Prior Publication Data

US 2012/0158279 A1 Jun. 21, 2012

(51) Int. Cl.
*G01M 17/00* (2006.01)

(52) U.S. Cl.
USPC ..... 701/29.1; 701/32.1; 701/33.4; 701/124; 701/110; 60/419; 60/413

(58) Field of Classification Search
USPC ..... 701/110, 124
See application file for complete search history.

(56) References Cited

U.S. PATENT DOCUMENTS

| | | | | |
|---|---|---|---|---|
| 4,035,621 | A | 7/1977 | Kemp | |
| 4,646,853 | A * | 3/1987 | Sugden et al. | 175/94 |
| 4,747,301 | A | 5/1988 | Bellanger | |
| 4,790,715 | A * | 12/1988 | Alexander | 414/489 |
| 5,082,071 | A | 1/1992 | Kyrtsos et al. | |
| 5,105,895 | A | 4/1992 | Kyrtsos | |
| 5,165,191 | A * | 11/1992 | Davis | 37/409 |
| 5,220,968 | A | 6/1993 | Weber | |
| 5,363,304 | A | 11/1994 | Awano et al. | |
| 5,599,158 | A | 2/1997 | Ajilore | |
| 5,659,470 | A | 8/1997 | Goska et al. | |
| 5,815,826 | A | 9/1998 | Henderson et al. | |
| 5,845,226 | A * | 12/1998 | Ajima | 701/409 |
| 5,924,493 | A | 7/1999 | Hartman et al. | |
| D412,506 | S | 8/1999 | Boyer et al. | |
| 5,941,921 | A | 8/1999 | Dasys et al. | |
| 5,955,706 | A | 9/1999 | Fonkalsrud et al. | |
| 6,349,252 | B1 | 2/2002 | Imanishi et al. | |
| 6,816,761 | B2 | 11/2004 | Denton | |
| 6,895,363 | B2 | 5/2005 | Erko et al. | |
| 6,917,846 | B1 | 7/2005 | Muller | |
| 6,959,241 | B2 * | 10/2005 | Itow et al. | 701/102 |
| 7,211,745 | B1 * | 5/2007 | Brown et al. | 177/1 |
| 7,257,513 | B2 | 8/2007 | Lilly | |
| 7,333,922 | B2 | 2/2008 | Cannon | |

(Continued)

FOREIGN PATENT DOCUMENTS

| | | |
|---|---|---|
| EP | 1403438 | 3/2004 |
| EP | 2101065 | 9/2009 |

*Primary Examiner* — Redhwan K Mawari
(74) *Attorney, Agent, or Firm* — Finnegan, Henderson, Farabow, Garrett & Dunner LLP

(57) ABSTRACT

Methods and systems are disclosed for evaluating performances of a piece of equipment and equipment operator. One disclosed method includes sensing a plurality of operating parameters of the equipment. The method then includes resolving a plurality of segments the equipment is sequentially performing from the sensed operating parameters to provide a sequence of resolved segments. The method then includes resolving what application the equipment is performing based upon the sequence of resolved segments to provide at least one resolved application. The method then includes applying at least one metric to the resolved application to provide at least one applied application metric. Then, the method includes evaluating the performance of the equipment and operator using the applied application metric. Various systems for installation on existing work equipments or new work equipments such as loaders and excavators are also disclosed.

20 Claims, 5 Drawing Sheets

(56) References Cited

U.S. PATENT DOCUMENTS

| | | | | |
|---|---|---|---|---|
| D590,846 | S | 4/2009 | Kinsinger et al. | |
| 8,311,970 | B2 * | 11/2012 | Mcaree et al. | 706/52 |
| 2001/0007087 | A1 | 7/2001 | Brandt et al. | |
| 2004/0055455 | A1 * | 3/2004 | Tabor et al. | 91/433 |
| 2004/0088103 | A1 * | 5/2004 | Itow et al. | 701/110 |
| 2005/0071519 | A1 * | 3/2005 | Hart et al. | 710/8 |
| 2008/0104953 | A1 * | 5/2008 | Vigholm | 60/413 |
| 2008/0127530 | A1 | 6/2008 | Kelly | |
| 2008/0208415 | A1 * | 8/2008 | Vik | 701/50 |
| 2009/0015422 | A1 | 1/2009 | Sixt, Jr. et al. | |
| 2009/0099897 | A1 * | 4/2009 | Ehrman et al. | 705/9 |
| 2010/0036696 | A1 | 2/2010 | Lang et al. | |
| 2010/0198466 | A1 | 8/2010 | Eklund et al. | |
| 2012/0158279 | A1 * | 6/2012 | Faivre et al. | 701/124 |

* cited by examiner

EQUIPMENT PERFORMANCE MONITORING SYSTEM AND METHOD

TECHNICAL FIELD

This disclosure relates generally to systems and methods for monitoring the performance of equipments and equipment operators.

BACKGROUND

Off-highway trucks, wheel loaders, excavators and other types of equipment are often called upon to perform repetitive segments or repetitive applications that include a sequence of segments. Methods for monitoring the performance such equipment and equipment operator performance currently exist and are important as management is provided with information about the equipment productivity, operator productivity, application efficiency and energy consumption.

Some of these monitoring methods utilize an approach in which operating parameters are monitored. For example, U.S. Pat. No. 5,955,706 measures lift cylinder pressure, lift cylinder displacement, tilt cylinder displacement, the direction of travel and other parameters to determine which segments of an application or work cycle the machine is undertaking. Individual segments and the overall application or cycle are timed. Similar monitoring is disclosed in U.S. Pat. No. 5,105,895 where sensed data is used to determine the application being performed and to monitor productivity.

It may also be desirable or necessary to monitor the performance of equipment operators in addition to or instead of the equipment itself. The need to monitor operator performance may be for managerial purposes to ensure that operators are complying with a minimum standard of performance and to help identify areas of potential operator improvement. Monitoring operator performance may also be desired by operators to provide the operator with an indication of their own performance in comparison with other operators and to demonstrate their level of competence to management.

One field in which performance monitoring is particularly effective is the operation of wheel loaders and excavators. Wheel loaders and excavators are expensive equipment. To ensure that the value of a wheel loader or excavator is being fully realized, it is important that an operator is operating the equipment efficiently. There are, however, many factors that need to be measured and considered to enable fair and useful comparisons to be made between different operators, between different pieces of equipment, between present and previous performances and between different operating conditions.

It is therefore desirable to provide a system and/or method capable of fairly evaluating an operator and a piece of equipment. Furthermore, it is desirable that performance-monitoring information is displayed in the cab and promptly made available to management and equipment operators alike of current performance-monitoring information.

SUMMARY OF THE DISCLOSURE

A system for evaluating performances of a machine and an operator of the machine is disclosed. The system may include a controller linked to a plurality of sensors for sensing a plurality of operating parameters of the machine. The controller may have a memory programmed with an algorithm for resolving a plurality of segments the machine is sequentially performing from the sensed operating parameters to provide a sequence of resolved segments. The memory of the controller may be programmed with an algorithm for resolving what application the machine is performing based on the sequence of resolved segments to provide at least one resolved application. The memory of the controller may also be programmed to apply at least one metric to the resolved application to provide at least one applied application metric for evaluating the performance of the machine and operator using the applied application metric.

In another system for evaluating the performances of a piece of equipment and an operator of the equipment, the equipment includes an engine, a transmission, a work implement, a lift cylinder, and a tilt cylinder connected to the work implement, and an implement pump. The system for evaluating includes a plurality of sensors for sensing a plurality of operating parameters. The sensors are linked to at least one control module. The at least one control module may be programmed to measure fuel consumption rate, payload weight, transmission gear, transmission output speed, lift angle, tilt angle, lift command, tilt command, and implement pump discharge pressure. The at least one control module may also include a memory programmed to resolve which plurality of segments the equipment and operator are sequentially performing from the sensed operating parameters to provide a sequence of resolved segments. The memory of the at least one control module may also be programmed to apply at least one metric to the sequence of resolved segments to provide at least one applied segment metric. The memory of the at least one control module may also be programmed to resolve what application the equipment is performing based upon the sequence of resolved segments to provide at least one resolved application. The memory of the at least one control module may also be programmed to apply at least one metric to the resolved application to provide at least one applied application metric. The system may also include a display linked to the at least one control module for displaying the at least one applied segment metric and the at least one applied application metric.

Methods of evaluating the performances of a piece of equipment and a piece of equipment operator are also disclosed. The disclosed method includes sensing a plurality of operating parameters of the equipment and resolving which plurality of segments that the equipment is sequentially performing based on the sensed operating parameters to provide a sequence of resolved segments. The method further includes resolving what application the equipment is performing based on the sequence of resolved segments to provide at least one resolved application. The method further includes applying at least one metric to the resolved application to provide at least one applied application metric. The method also includes evaluating the performance of the equipment and operator using the applied application metric.

Another disclosed method for evaluating performances of a piece of equipment and a piece of equipment operator includes sensing a plurality of operating parameters of the equipment and resolving which plurality of segments that the equipment and operator are sequentially performing based on the sensed operating parameters to provide a sequence of resolved segments. At least one metric is applied to at least one segment of the sequence of resolved segments to provide at least one applied segment metric. The method further includes resolving what application the equipment is performing based on the sequence of resolved segments to provide at least one resolved application and applying at least one metric to the resolved application to provide at least one applied application metric. The method also includes evaluating the performance of the equipment and operator using at least one of the applied segment metric and the applied application metric.

In any one or more of the disclosed methods or systems, the at least one operating parameter may be selected from the group consisting of engine speed, hydraulic pressure of lift cylinder, hydraulic pressure of tilt cylinder, lift lever position, tilt lever position, lift cylinder extension, tilt cylinder extension, transmission gear, transmission output speed, transmission input speed, implement pump discharge pressure, fuel consumption rate and payload weight.

In any one or more of the systems or methods described above, each segment may be selected from the group consisting of dig, travel loaded, dump, travel empty, swing loaded, swing empty, scrape, scrape dump, blade load, carry material, stationary weigh, spread material, return, equipment idle, grade, general travel, stationary loaded high idle, stationary loaded low idle, stationary empty high idle and stationary empty low idle.

In any of the methods or systems described above, the application may be selected from the group consisting of idle time, roading, loading, pile cleanup, load and carry, road maintenance, excavate, trenching, stockpiling and slot dozing.

In any of the methods or systems described above, at least one segment metric is applied to the resolved segments to provide at least one of applied segment metric.

In any one or more of the methods or systems described above, the segment metric may be selected from the group consisting of duration, fuel consumption, distance, payload, GPS coordinates, transmission gear, operating efficiency, average engine speed, average engine coolant temperature, average hydraulic pressure of lift cylinder, average hydraulic pressure of tilt cylinder, hydraulic pump pressure, hydraulic circuit pressure, hydraulic oil temperature and energy consumption.

In any one or more of the methods or systems described above, the application metric may be selected from the group consisting of duration, fuel consumption, distance, payload, GPS coordinates, transmission gear, operating efficiency, average engine speed, average engine coolant temperature, average hydraulic pressure of lift cylinder, average hydraulic pressure of tilt cylinder, hydraulic pump pressure, hydraulic circuit pressure, hydraulic oil temperature and energy consumption.

In any one or more of the methods or systems described above, the applied segment metric and/or the applied application metric may be displayed on a visual display that can be seen by the operator. Such a visual display may be mounted in the cab of the equipment.

In any one or more of the methods or systems described above, the number of applications performed in a trip may be calculated. A trip may be defined as a shift, such as a work shift, a day or other predetermined time periods.

In any one or more of the methods or systems described above, at least one metric may be applied to the calculated number of applications in the trip to provide at least one applied trip metric. The at least one applied trip metric may be selected from the group consisting of production mass per unit time, fuel consumption in unit volume of fuel per unit time, efficiency in mass of material moved per unit volume of fuel, average time per application, average number of applications per trip, total payload per trip, total fuel consumed per trip and total time per trip.

In any one or more methods or systems described above, the at least one applied trip metric may be displayed on the visual display that can be seen by the operator.

BRIEF DESCRIPTION OF THE DRAWINGS

FIG. 3 illustrates a conventional visual display for viewing by the operator of a loader or excavator.

DETAILED DESCRIPTION

This disclosure enables equipment operators to monitor application (cycle) time and other performance metrics (productivity, efficiency, and fuel consumption) per application onboard a piece of equipment without manual interface. This disclosure also provides for the transmission to management of data including machine and operator productivity, efficiency, and energy (or fuel) consumption. The data, or the analysis of the data, allow management to make better decisions on operator coaching, machine placement, maintenance scheduling. The same data can be given to dealers and manufacturer to track, manage and plan improvements. In addition to wheel loaders and excavators, this disclosure is applicable to any piece of equipment with the linkage, the extension or attraction of which can be sensed, or any equipment that performs different, but distinct applications (operations).

In this disclosure, the application may be identified after it has been segmented or broken down into specific segments. Each segment of an application may be timed and performance metrics may be recorded for each segment as well as the application as a whole (e.g., productivity, fuel consumption, efficiency etc.). For example, a wheel loader operator may be loading a truck. Truck loading would be the application. The disclosed algorithm would identify individual segments, such as dig, travel loaded, dump, and travel empty segments when identifying truck loading as the application. For each of these segments, performance metrics would be recorded. This combination of segments forms a truck loading application, causing the algorithm to record a truck loading application with appropriate performance metrics.

Figure 1:
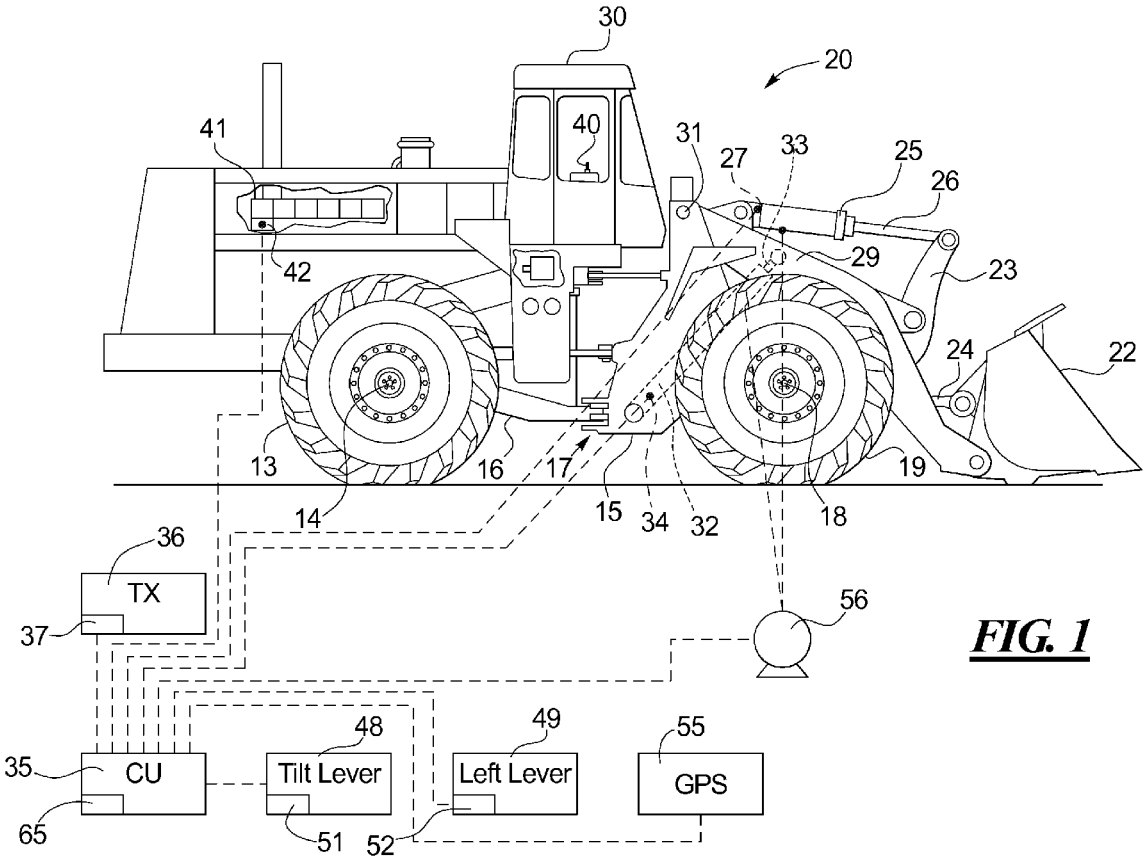
FIG. 1 is a schematic illustration of a disclosed equipment performance monitoring system installed on a loader.

FIG. 1 illustrates a system 20 installed on a piece of equipment 21 that, in the example of FIG. 1, is a medium wheel loader (MWL). The equipment 21 includes an articulated chassis that includes a front frame 15 that is coupled to a rear frame 16 by a hitch 17. The front frame 15 is supported by a front axle 18, which is supported by two wheels 19. The rear frame 16 is supported by a rear axle 14 which, in turn, is supported by a pair of rear wheels 13. The rear frame 16 supports an engine 41 and a cab 30 that includes a plurality of controls 40.

In FIG. 1, the front frame 15 supports a bucket 22 that is coupled to a tilt arm assembly 23 by a link 24. The tilt arm assembly 23 couples the link 24 and bucket 22 to a tilt cylinder 25 and tilt piston 26. In the embodiment illustrated, the tilt cylinder 25 houses a tilt sensor 27 which may be used to generate a signal to a controller 35 indicative of the displacement of the tilt piston 26 with respect to the tilt cylinder 25. The bucket 22 is also coupled to a lift arm assembly 29 which couples the bucket 22 to a lift arm pivot 31. The lift arm assembly 29 is coupled to a lift cylinder 32 and lift piston 33. The lift cylinder 32 may house a lift sensor 34. The lift sensor 34 may also be coupled to the controller 35 which may be a microprocessor or other type of controller and which may also be the type of controller used for electronic control units (ECUs). Tools other than buckets 22 may be supported by the lift arm assembly 29, such as forks, couplers, various bucket styles etc.

The equipment 21 includes a transmission 36 and one or more transmission sensors shown at 37. The one or more transmission sensors 37 may generate signals indicative of transmission output speed, transmission input speed, transmission gear, direction of travel etc. for generating signals. The lift sensor 34 may also send data to the controller 35 for generating a lift cylinder displacement. The equipment 21 includes an engine 41 and one or more engine sensors 42 that may generate data that is transmitted to the controller 35 and which is used to generate operating parameters such as engine speed, fuel rate, etc.

The equipment 21 may also include a tilt lever 48 and lift lever 49. The tilt lever 48 may include one or more tilt lever sensors 51 and the lift lever 49 may include one or more lift lever sensors 52. The sensors 51, 52 may be linked to the controller 35 for purposes of generating a tilt command signal or a lift command signal. The equipment may also be equipped with a GPS system 55 and one or more hydraulic pumps, one of which is shown at 56 in FIG. 1. The pump 56 may be used to drive the operation of the tilt cylinder 27 and tilt piston 26 as well as the lift cylinder 32 and lift piston 33 as illustrated in FIG. 1. The pump 56 may also be linked to the controller 35 for purposes of generating a pressure signal or hydraulic power signal. A torque converter outlet speed (TCOS) may also be generated by the transmission 36 and one or more transmission sensors 37.

Figure 2:
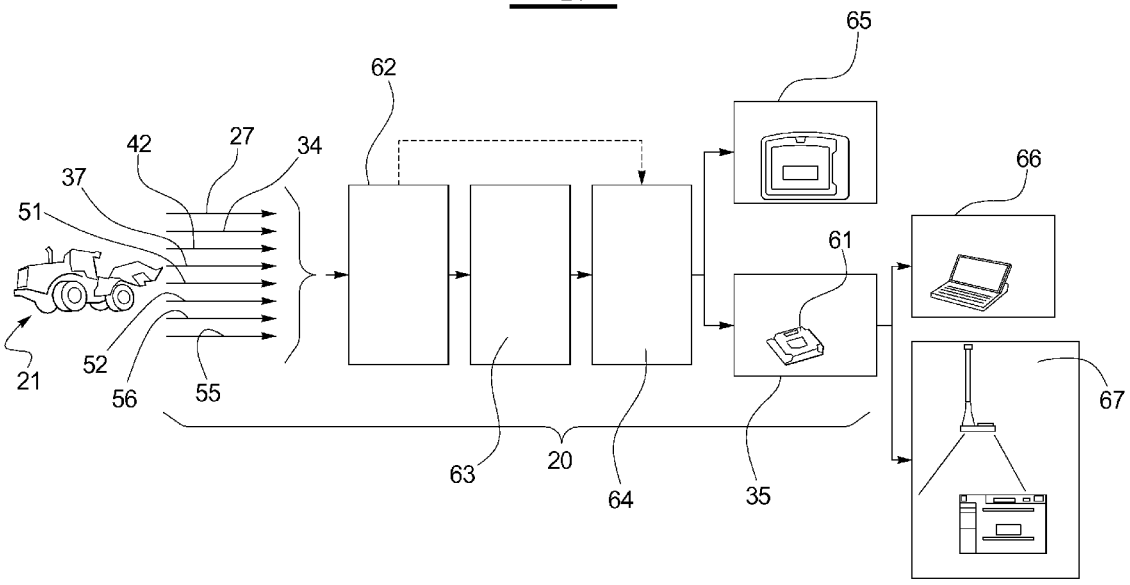
FIG. 2 is a schematic diagram illustrating a disclosed method of evaluating performances of a piece of equipment and an operator.

A hybrid schematic illustration and flow chart of the equipment 21, the disclosed system 20 and disclosed method is provided in FIG. 2. The equipment 21 may be equipped with a plurality of sensors such as those shown at 27, 34, 42, 37, 51-52, 55-56 in FIG. 2. The signals generated by the sensors 27, 34, 42, 37, 51-52, 55-56 may be used to generate a plurality of operating parameters. At step 62, the controller 35 may be programmed to resolve which specific segment the equipment is undertaking based upon the generated operating parameters. For example, at step 62, the controller 35 may resolve at least one segment that the equipment 21 is undertaking, such as dig, travel loaded, dump, travel empty, scrape, scrape dump, idle, etc. The controller 35 may also be programmed to resolve an application from a sequence of segments. The controller 35 may also be programmed to apply one or more metrics to the resolved segment or resolved sequence of segments to provide at least one applied segment metric. The applied segment metric or metrics may be used for purposes of evaluating a piece of equipment and an operator performance.

After one or more segments or a sequence of segments is resolved at 62, the controller 35 may be programmed to resolve which application the equipment 21 is undertaking based on the resolved segment or resolved sequence of segments at step 63. For example, based upon a sequence of segments, the controller 35 may determine that the equipment 21 is undertaking a loading application, a load and carry application, a pile cleanup application, a roading application, or some other application typically carried out by the equipment 21. At step 64, one or more application metrics may be applied to the resolved application for generating one or more applied application metrics such as application duration, application fuel use, distance traveled, payload, production rate, efficiency, idle time, etc. The one or more applied application metrics and one or more applied segment metrics may be displayed on a visual display 65 as illustrated in FIG. 2 and FIGS. 6-11. The applied segment metrics and applied application metrics may also be transmitted by the controller 35 to an offsite computer 66 for evaluation by management. The data may be sent to the offsite computer 66 using a cellular transmission system such as a GSM system 67 or other wireless transmission system.

Definitions of Applications, Segments and Metrics

A list of possible applications, segments and metrics and their definitions is presented below:

| APPLICATION DEFINITIONS | |
|---|---|
| Loading | Typically loading trucks or hoppers with a travel loaded distance typically less than 55 yards. Primary segments include: travel empty, dig, travel loaded and dump. |
| Load & carry | Typically loading trucks or hoppers with a travel loaded distance typically greater than 55 yards. Primary segments include: travel empty, dig, travel loaded and dump. |
| Pile cleanup | Cleanup or maintenance of stockpiled material. Primary segments include: scrape and scrape dump. |
| Roading | A travel empty segment that occurs outside of the normal production application. |
| Other | A sequence of segments that do not fall into one of the above defined applications. An idle that occurs outside of the production cycle will be characterized as other. |
| SEGMENT DEFINITIONS | |
| Travel empty | Any travel that does not occur between a dig and a dump. |
| Travel loaded | Any travel that occurs between a dig and a dump. |
| Dig | Segment of placing bucket near ground, penetrating pile, and then moving the bucket to a carry position. |
| Dump | Moving bucket from a carry position to a dump position. |
| Scrape | Segment of scraping or picking up material with the bucket. Usually completed during a pile cleanup application. |
| Scrape dump | Moving bucket to a dump position after a scraping. |
| Machine idle | Neutral gear, no ground speed, engine RPM < 800, no implement commands and key on. |
| Unknown | Any action that is not defined by one of the previous segments. Usually movement of the implement while the machine is stationary. |

-continued

| METRIC DEFINITIONS | |
|---|---|
| Total payload | Sum of all payload measurements independent of application. |
| Average cycle payload | Ratio of total payload to the number of payload measurements recorded. |
| Total operation time | Sum of time the machine is keyed on and engine speed >0 RPM. |
| Production | Ratio of total payload to total operation time. |
| Productivity | Ratio of total payload to total loading and load & carry application times. |
| Total fuel | Sum of all fuel consumed by the engine independent of application. |
| Average fuel rate | Ratio of total fuel to total operation time. |
| Fuel per ton | Fuel consumed per ton of payload transported. |
| Production efficiency | Ratio of total payload to total fuel. |
| Average loading distance | Average distance (travel empty and travel loaded) that occurred during a loading application. |
| Total distance | Total distance traveled, independent of application type. |
| Operating efficiency | A measurement of how efficiently the machine is being utilized. Determined by how effectively power is transferred to the implement and tires for the amount of fuel being consumed. |

A controller 35 may be programmed with an information management system, such as a vital information management system (VIMS), which collects and transmits equipment data and turns it into valuable information used to track productivity, equipment performance, surface scheduling, trends, diagnostics, and equipment condition monitoring. The controller 35 is preferably located on board the equipment 21. A third generation of the VIMS system (VIMS3G) (I believe the 3G stands for the cellular communication protocol, not the 3rd generation of the VIMS system) is also now available from the assignee, Caterpillar of Peoria Ill., USA. In addition to providing production and performance information, the VIMS may also provide detection of an impeding or abnormal condition in one or more of the systems of the equipment 21 and alerting of the operator to take an appropriate action in response to the impeding or abnormal condition.

The GSM communication system may also include an additional application provided by Caterpillar under the VISIONLINK™ trademark which is a communications interface. The VISIONLINK application provides the capability to communicate on a cellular network (GSM), which is advantageous due to its wide band width and therefore the ability to accommodate large quantities of data. Existing satellite-based hardware can be upgraded to accommodate such an application.

Figure 3:
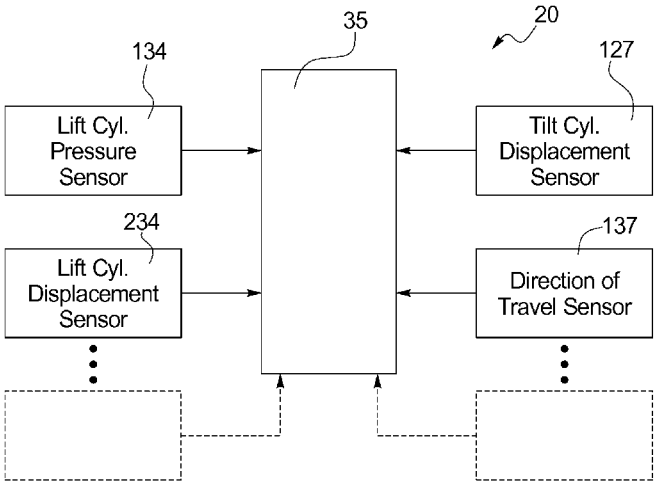
FIG. 3 schematically illustrates the communication between the disclosed sensors and the disclosed control unit.
Figure 4:
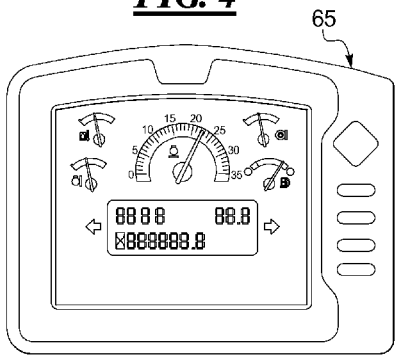
FIG. 4 illustrates a display of various applied metrics in accordance with this disclosure. This display is currently not in production. May be better not to show a screen shot of it. It does not show anything related to the performance monitoring features.
Figure 5:
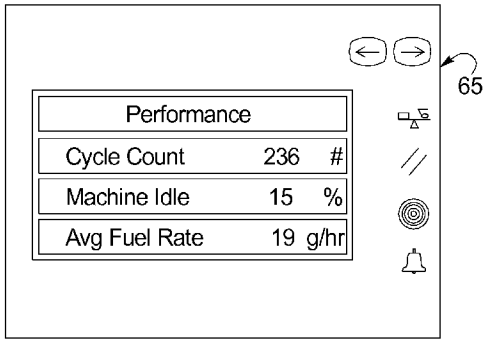
FIG. 5 illustrates another display of various applied metrics in accordance with this disclosure.
Figure 6:
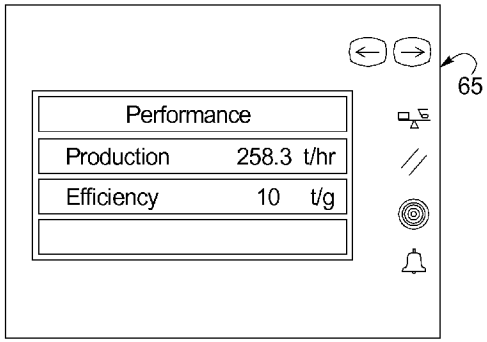
FIG. 6 illustrates another display of various applied metrics in accordance with this disclosure.
Figure 7:
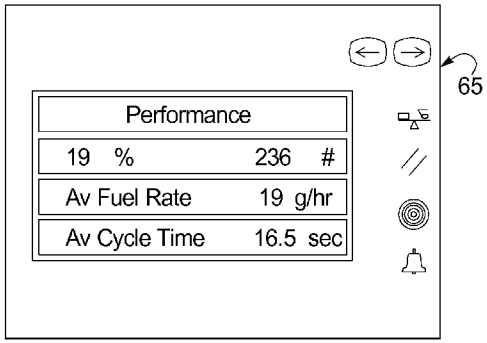
FIG. 7 illustrates another display of various applied metrics in accordance with this disclosure.

FIG. 3 illustrates the sensing of four different signals using a lift cylinder pressure sensor 134, a lift cylinder displacement sensor 234, a tilt cylinder displacement sensor 127 and a direction of travel sensor 137 for generating one or more resolved segments, one or more resolved sequence of segments, one or more resolved applications and the application of various metrics to the resolved segments, resolved sequence of segments and resolved applications.

Figure 8:
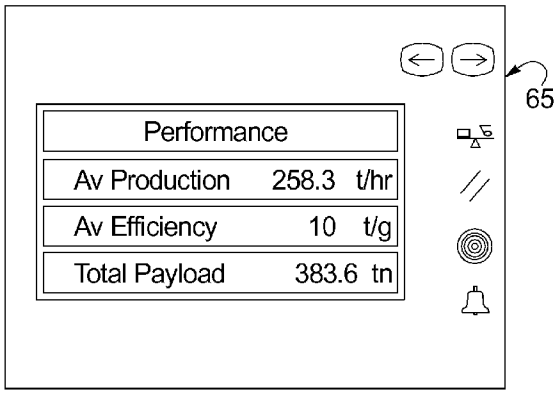
FIG. 8 illustrates another display of various applied metrics in accordance with this disclosure.

FIGS. 4-8 illustrate different data that can be displayed on the visual display such as the application or cycle count, percentage of time the equipment is in idle and average fuel consumption rate (FIG. 5), the production in weight per hour and efficiency in gross payload weight per gallon of fuel (FIG. 6), performance efficiency, cycle count, average fuel rate and average application time (FIG. 7), average production in weight per hour, and average efficiency in weight per gallon of fuel and total payload (FIG. 8).

Figure 9:
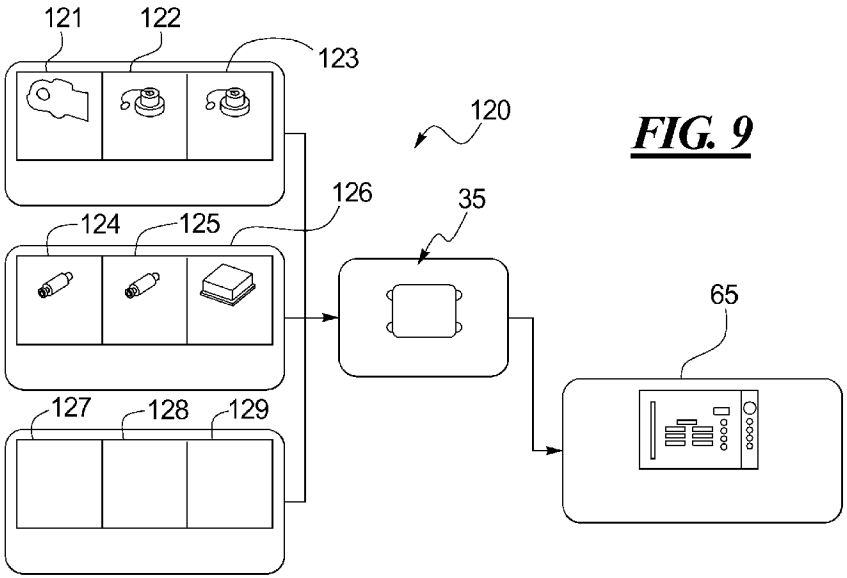
FIG. 9 schematically illustrates the relationship between the sensors for sensing operating parameters, the disclosed control module which may be programmed to convert the raw data from the sensors into understandable operating parameters and apply one or more segment, application or trip metrics to the sensed data and which may be programmed to display selected applied metrics on a visual display for viewing by the operator.

Finally, FIG. 9 illustrates a system 120 that is particularly appropriate for excavators and that includes a bucket displacement sensor 121, a stick rotary sensor 122 and a boom rotary sensor 123. The system 120 also includes pressure sensors 124, 125 and an inertial measurement unit (IMU 126). The system 120 may also include a sensor 127 for measuring the idler pump discharge pressure, a sensor 128 for measuring the drive pump discharge pressure and a sensor 129 for measuring engine speed. A single controller 35 or multiple controllers 35, 135, 235 may be employed and some of the applied metrics may be displayed on the visual display 65.

Accordingly, various systems and methods for monitoring the performance of a piece of equipment and the equipment operator of that equipment are disclosed. Sensors are provided for generating various signals that are sent to a controller 35. The various sensors may include, but are not limited to engine speed, gear, transmission output speed and direction, torque converter output speed, lift lever command, tilt lever command, lift position, tilt position, implement pump discharge pressure, fuel consumption rate and payload. The disclosed systems use equipment sensor signals and define segmentation rules to calculate cycle counts, durations, distances, energy usage and various performance indexes to inform and/or coach the operator and to inform the manager/owner of the equipment. When combined with a payload calculation system, cycle payloads can be combined with performance metrics to calculate production information such as payload/hour and payload/fuel.

The controller 35 includes a memory 61 that may be programmed with software that resolves which segment is being performed based upon the sensor input signals. The segments include, but are not limited to, travel empty (travel before dig), dig (begins with a bucket parallel and close to the ground and ends with the bucket in a carry position), travel loaded (travel after dig), stationary weigh (equipment not moving, lifting or lowering implement to determine payload), dump (dump material as bucket moves from carry position to dump position), scrape (pick up material for pile dressing with bucket parallel and close to the ground), scrape dump (dump scraped material from a partially racked bucket position), idle and miscellaneous stationary positions. From the resolved segment or segments, a sequence of resolved segments can be defined and from a sequence of resolved segments, an application that the equipment is undertaking can be determined. The various applications include, but are not limited to, loading (segments include travel empty, dig, stationary weigh, travel loaded, dump), load and carry (segments include travel empty, dig, stationary weigh, travel loaded, dump), stock piling (segments include scrape, scrape dump, travel empty), roading (segment includes travel empty), equipment idle time and miscellaneous time (non-recognized cycles or partial cycles). From the resolved segments and applications, equipment utilization information is calculated for display to the operator on the visual display 65 or stored in the memory 61 for off-site processing. Information or applied metrics include, but are not limited to:

| METRICS | UNITS |
|---|---|
| Segment Type Count | # |
| Segment Durations | Sec |
| Segment Distance | M |
| Segment Fuel Used | L |
| Segment Efficiency Ratio | % |

-continued

| METRICS | UNITS |
|---|---|
| Cycle Type per Clock Time | ID |
| Cycle Duration | Sec |
| Cycle Type Distance | M |
| Cycle Type Fuel Used | L |
| Last Cycle Duration | sec |
| Last Cycle Distance | M |
| Last Cycle Fuel Used | L |
| Last Cycle Efficiency Ratio | % |
| Total Segment Count | # |
| Total Cycle Count | # |
| Total Distance | M |
| Total Fuel Used Daily | L/Shift |
| Total Payload (Loading or Load & Carry) | tonnes |
| Total Equipment Idle Time | H |
| Total Work Time | H |
| Equipment Idle Time by Clock Time | H or % |
| Work Time by Clock Time | H |
| Average Segment Duration | sec |
| Average Cycle Duration | sec |
| Average Distance per Cycle Type | m |
| Average Fuel per Segment | L |
| Average Fuel per Cycle | L |
| Average Fuel per Cycle Type | L |
| Average Fuel Consumption Rate | L/h |
| Average Payload per Cycle Type (Loading & Load & Carry) | tonnes |
| Average Operating Efficiency Ratio | % |
| Instantaneous Fuel Rate | L/h |
| Instantaneous Efficiency Ratio | % |
| Efficiency-Payload/Fuel Used (Loading or Load & Carry) | tonnes/L |
| Total Production-Payload/Duration (Loading or Load & Carry) | tonnes/h |

INDUSTRIAL APPLICABILITY

A system is provided for evaluating the performance of a piece of equipment, wherein the equipment performs one or more applications, with each application including at least one segment or task. The system includes a controller in communication with a plurality of sensors that can detect various aspects of the operation of the equipment. For example, the controller may be in communication with any one or more of a lift sensor, tilt sensor, transmission sensor, engine sensor, tilt lever sensor, lift lever sensor, hydraulic pump, etc. From the data transmitted to the controller by the sensor or sensors, the controller can resolve which segment the piece of equipment is undertaking and, from a plurality of resolved segments, which application the piece of equipment is currently undertaking. The controller may then apply various metrics to the data for purposes of evaluating or monitoring the piece of equipment and the equipment operator.

One disclosed method for evaluating the performance of a piece of equipment and an operator of a piece of equipment include sensing a plurality of operating parameters of the equipment, resolving a plurality of segments the equipment and operator are sequentially performing from the sensed operating parameters to provide a sequence of resolved segments, applying at least one metric to at least one segment of the sequence of resolved segments to provide at least one applied segment metric, resolving what application the equipment is performing based upon the sequence of resolved segments to provide at least one resolved application, applying at least one metric to the resolved application to provide at least one applied application metric and evaluating the performance of the equipment and operator using at least one of the applied segment metric and applied application metric.

Typical industrial applications include use of a medium wheel loader in a quarry or sand and gravel pit that may involve loading trucks to within an accuracy of 0.22 tonnes (500 pounds) or 0.45 tonnes (1,000 pounds). Such an operation may include loading of railcars, river barges, or a hopper a short distance away. Such an operation may also include feeding hoppers for aggregate production, stock piling or conducting truck/loader path maintenance. In an asphalt plant, such a medium wheel loader may be used to keep hoppers filled with aggregates, stock pile incoming aggregates and recycled materials, and yard maintenance or cleanup. In a concrete ready-mix plant, loader jobs include, but are not limited to, keeping hoppers filled with aggregate, stock piling incoming aggregates, concrete truck carry back sludge disposal and yard maintenance and cleanup.

In addition to the visual display 65 screen formats illustrated in FIGS. 4-8, additional screen formats include, but are not limited to:

| | |
|---|---|
| Cycle Count (#) | Numerical |
| Equipment Idle Time (%) | Numerical |
| Instantaneous Fuel Rate (L/h) | Graphical bar |
| Av Fuel Rate (L/h) | Numerical |
| Cycle Count # | Numerical |
| Equipment Idle Time (%) | Numerical |
| Instantaneous Fuel Rate (L/h) | Graphical bar |
| Av Fuel Rate (L/h) | Numerical |
| Production (tonnes/h) | Numerical |
| Efficiency (tonnes/L) | Numerical |
| Daily Equipment Idle Time (h) | Numerical |
| Daily Equipment Idle Time (%) | Numerical |
| Daily Cycle Count (#) | Numerical |
| Daily Avg Cycle Duration (sec) | Numerical |
| Daily Avg Operating Efficiency (%) | Numerical |
| Daily Avg Fuel rate (L/h) | Numerical |
| Daily Avg Fuel per Cycle (L) | Numerical |
| Daily Fuel (L) | Numerical |
| Daily Avg Production (Tonnes/h) | Numerical |
| Daily Avg Efficiency (Tonnes/L) | Numerical |
| Daily Payload (Tonnes) | Numerical |

The invention claimed is:

1. A system for evaluating performances of a machine and an operator of the machine, the system, comprising:

a controller, the controller linked to a plurality of sensors for sensing a plurality of operating parameters indicative of an operation of the machine and operator;

the controller having a memory programmed with an algorithm for resolving a plurality of segments the machine is sequentially performing from the sensed operating parameters to provide a sequence of resolved segments, each segment comprising a specific part of an application of the machine and operator;

the memory of the controller also being programmed with an algorithm for resolving what application the machine is performing based on the sequence of resolved segments to provide at least one resolved application, the application comprising a type of operation performed by the machine and operator;

the memory of the controller also being programmed to apply at least one metric to the resolved application to provide at least one applied application metric for evaluating the performance of the machine and operator using the applied application metric, the at least one metric measuring performance of the resolved application.

2. The system of claim 1 wherein the at least one operating parameter is selected from the group consisting of engine speed, hydraulic cylinder pressure(s), command lever position, cylinder extension(s), linkage angle(s), machine inclination, machine acceleration, GPS coordinates, transmission gear, transmission output speed, transmission input speed, implement pump discharge pressure, fuel consumption rate and payload weight.

3. The system of claim 1 wherein each segment is selected from the group consisting of dig, travel loaded, dump, travel empty, swing loaded, swing empty, scrape, scrape dump, blade load, carry material, stationary weigh, spread material, return, machine idle, grade, general travel, stationary loaded high idle, stationary loaded low idle, stationary empty high idle and stationary empty low idle.

4. The system of claim 1 wherein each application is selected from the group consisting of idle time, roading, loading, pile cleanup, load and carry, road maintenance, excavate, trenching, stockpiling and slot dozing.

5. The system of claim 1 further including applying at least one segment metric to the resolved segments to provide at least one applied segment metric.

6. The system of claim 5 wherein the at least one segment metric is selected from the group consisting of duration, fuel consumption, distance, payload, GPS coordinates, transmission gear, operating efficiency, average engine speed, average engine coolant temperature, average hydraulic circuit pressure, hydraulic pump discharge pressure, hydraulic oil temperatures and energy consumption.

7. The system of claim 1 wherein the at least one application metric is selected from the group consisting of duration, fuel consumption, distance, payload, GPS coordinates, transmission gear, operating efficiency, average engine speed, average engine coolant temperature, average hydraulic circuit pressure, hydraulic pump pressure, hydraulic oil temperatures and energy consumption.

8. The system of claim 7 further including a display for displaying the at least one applied segment metric on a visual display that can be seen by an operator of the machine.

9. The system of claim 6 further including the display for displaying the at least one applied application metric on a visual display that can be seen by an operator of the machine.

10. A method of evaluating performances of a machine and an operator of the machine, the method comprising:

sensing a plurality of operating parameters of the machine with a plurality of sensors, the operating parameters indicative of an operation of the machine and operator;

resolving a plurality of segments the machine and operator are sequentially performing from the sensed operating parameters to provide a sequence of resolved segments, each segment comprising a specific part of an application of the machine and operator;

applying at least one metric to at least one segment of the sequence of resolved segments to provide at least one applied segment metric;

resolving what application the machine is performing based on the sequence of resolved segments to provide at least one resolved application, the application comprising a type of operation performed by the machine and operator;

applying at least one metric to the resolved application to provide at least one applied application metric, the at least one metric measuring performance of the resolved application;

evaluating the performance of the machine and operator using at least one of the applied segment metric and the applied application metric; and altering at least one of the piece of equipment, operation of the piece of equipment and the behavior of the operator based on at least one of the applied application metric and applied segment metric.

11. The method of claim 10 wherein the at least one operating parameter is selected from the group consisting of engine speed, hydraulic cylinder pressure(s), command lever position, cylinder extension(s), linkage angle(s), machine inclination, machine acceleration, GPS coordinates, transmission gear, transmission output speed, transmission input speed, implement pump discharge pressure, fuel consumption rate and payload weight.

12. The method of claim 11 wherein each segment is selected from the group consisting of dig, travel loaded, dump, travel empty, swing loaded, swing empty, scrape, scrape dump, blade load, carry material, stationary weigh, spread material, return, machine idle, grade, general travel, stationary loaded high idle, stationary loaded low idle, stationary empty high idle and stationary empty low idle.

13. The method of claim 10 wherein each application is selected from the group consisting of idle time, roading, loading, pile cleanup, load and carry, road maintenance, excavate, trenching, stockpiling and slot dozing.

14. The method of claim 10 wherein the at least one segment metric is selected from the group consisting of duration, fuel consumption, distance, payload, GPS coordinates, transmission gear, operating efficiency, average engine speed, average engine coolant temperature, average hydraulic circuit pressure, hydraulic pump discharge pressure, hydraulic oil temperatures and energy consumption.

15. The method of claim 13 wherein the at least one application metric is selected from the group consisting of duration, fuel consumption, distance, payload, GPS coordinates, transmission gear, operating efficiency, average engine speed, average engine coolant temperature, average hydraulic pressure of lift cylinder, average hydraulic pressure of tilt cylinder, hydraulic pump pressure, hydraulic circuit pressure, hydraulic oil temperatures and energy consumption.

16. The method of claim 13 further including displaying the at least one applied segment metric and at least one applied application metric on a visual display that can be seen by an operator of the machine.

17. The method of claim 13 further including calculating the number of applications performed in a trip.

18. The method of claim 17 further including applying at least one metric to the calculated number of applications in the trip to provide at least one applied trip metric, the at least one applied trip metric being selected from the group consisting of production mass per unit time, fuel consumption in unit volume of fuel per unit time, efficiency in mass of material moved per unit volume of fuel, average time per application, average time per task, total number of applications per trip, total number of tasks per trip, total payload per trip, total fuel consumed per trip and total time per trip.

19. The method of claim 18 further including displaying the at least one applied trip metric on a visual display that can be seen by an operator of the machine.

20. A system for evaluating performances of a machine and an operator of the machine, the machine including an engine, a transmission, a work implement, a lift cylinder and a tilt cylinder connected to the work implement and an implement pump, the system comprising:

a plurality of sensors for sensing a plurality of operating parameters, the plurality of sensors linked to the at least one control module, the operating parameters indicative of an operation of the machine and operator;

the at least one control module having a memory programmed to measure fuel consumption rate, payload weight, transmission gear, transmission output speed, cylinder extension, linkage angle(s), lever commands, and hydraulic pump discharge pressure; (these are examples, other parameters could be used)

the memory of the at least one control module also being programmed to resolve a plurality of segments the machine and operator are sequentially performing from the sensed operating parameters to provide a sequence of resolved segments, each segment comprising a specific part of an application of the machine and operator;

the memory of the at least one control module also being programmed to apply at least one metric to the sequence of resolved segments to provide at least one applied segment metric;

the memory of the at least one control module also being programmed to resolve what application the machine is performing based on the sequence of resolved segments to provide at least one resolved application, the application comprising a type of operation performed by the machine and operator;

the memory of the at least one control module also being programmed to apply at least one metric to the resolved application to provide at least one applied application metric, the at least one metric measuring performance of the resolved application;

a display linked to the at least one control module for displaying the at least one applied segment metric and the at least one applied application metric.

* * * * *

UNITED STATES PATENT AND TRADEMARK OFFICE

CERTIFICATE OF CORRECTION

PATENT NO. : 8,660,738 B2
APPLICATION NO. : 12/967649
DATED : February 25, 2014
INVENTOR(S) : Faivre et al.

It is certified that error appears in the above-identified patent and that said Letters Patent is hereby corrected as shown below:

Title Page, Column 1, Item no. 73 (Assignee), line 1, delete "Catepillar" and insert -- Caterpillar --.

Signed and Sealed this
Fifteenth Day of September, 2015

Michelle K. Lee

Michelle K. Lee
*Director of the United States Patent and Trademark Office*